US010093115B2

(12) United States Patent
La Vos et al.

(10) Patent No.: US 10,093,115 B2
(45) Date of Patent: Oct. 9, 2018

(54) METHOD FOR PRINTING ON A PLURALITY OF SHEETS; AN INKJET PRINTING APPARATUS

(71) Applicant: Océ-Technologies B.V., Venlo (NL)

(72) Inventors: Peter G. La Vos, Venlo (NL); Roy H. R. Jacobs, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/853,300

(22) Filed: Dec. 22, 2017

(65) Prior Publication Data

US 2018/0117932 A1 May 3, 2018

Related U.S. Application Data

(63) Continuation of application No. PCT/EP2016/065871, filed on Jul. 5, 2016.

(30) Foreign Application Priority Data

Jul. 9, 2015 (EP) ..... 15175996

(51) Int. Cl.
*B41J 13/00* (2006.01)
*B41J 11/00* (2006.01)
(Continued)

(52) U.S. Cl.
CPC ..... *B41J 13/0027* (2013.01); *B41J 2/2146* (2013.01); *B41J 2/375* (2013.01);
(Continued)

(58) Field of Classification Search
CPC ..... B41J 11/00; B41J 11/0005; B41J 11/001; B41J 11/0025; B41J 11/003;
(Continued)

(56) References Cited

U.S. PATENT DOCUMENTS 5,831,655 A 11/1998 Asawa et al.
2008/0204497 A1 8/2008 Furuhata
(Continued)

FOREIGN PATENT DOCUMENTS

JP 2007-276292 A 10/2007

OTHER PUBLICATIONS

European Search Report issued in Application No. EP 15 17 5996 dated Dec. 23, 2015.

(Continued)

*Primary Examiner* — Kristal Feggins
(74) *Attorney, Agent, or Firm* — Birch, Stewart, Kolasch & Birch, LLP

(57) ABSTRACT

A method for printing on a plurality of sheets includes the steps of: arranging the plurality of sheets on a support surface of an endless conveyor, the plurality of sheets including a first sheet and a second sheet being arranged at a sheet-to-sheet distance between one another; advancing the plurality of sheets on the support surface in a conveying direction along a print head assembly for applying droplets of ink on the sheets; providing a suction force through perforations arranged in the support surface for holding the plurality of sheets on the support surface, wherein the suction force provides an air flow through uncovered perforations present in the sheet-to-sheet distance in a print region between the print head assembly and the support surface; and forming an image by the print head assembly on each of the plurality of sheets supported on the support surface of the conveyor by applying droplets of ink. The method further includes the step of controlling the sheet-to-sheet distance in response to a dew formation attribute for indicating dew formation on the print head assembly.

20 Claims, 8 Drawing Sheets

(51) Int. Cl.

| | |
|---|---|
| ***B41J 29/377*** | (2006.01) |
| ***B41J 2/375*** | (2006.01) |
| ***B41J 3/60*** | (2006.01) |
| ***B41J 29/38*** | (2006.01) |
| ***B41J 2/21*** | (2006.01) |

(52) U.S. Cl.
CPC ..... *B41J 3/60* (2013.01); *B41J 11/002* (2013.01); *B41J 11/007* (2013.01); *B41J 11/0085* (2013.01); *B41J 29/377* (2013.01); *B41J 29/38* (2013.01)

(58) Field of Classification Search
CPC ... B41J 11/0035; B41J 11/0045; B41J 11/005; B41J 11/0055; B41J 11/0085; B41J 11/009; B41J 11/0095; B41J 11/42; B41J 11/485; B41J 11/53
See application file for complete search history.

(56) References Cited

U.S. PATENT DOCUMENTS

| | | | | |
|---|---|---|---|---|
| 2013/0050376 | A1* | 2/2013 | Houjou ..... | B41J 11/0085 347/104 |
| 2015/0344249 | A1* | 12/2015 | Inoue ..... | B41J 11/0085 347/102 |
| 2017/0113470 | A1* | 4/2017 | Okazaki ..... | B41J 11/0085 |

OTHER PUBLICATIONS

International Search Report for PCT/EP2016/065871 (PCT/ISA/210) dated Oct. 24, 2016.

Written Opinion of the International Searching Authority for PCT/EP2016/065871 (PCT/ISA/237) dated Oct. 24, 2016.

* cited by examiner

METHOD FOR PRINTING ON A PLURALITY OF SHEETS; AN INKJET PRINTING APPARATUS

CROSS REFERENCE TO RELATED APPLICATIONS

This application is a Continuation of PCT International Application No. PCT/EP2016/065871, filed on Jul. 5, 2016, which claims priority under 35 U.S.C. 119(a) to Patent Application No. 15175996.6, filed in Europe on Jul. 9, 2015, all of which are hereby expressly incorporated by reference into the present application.

FIELD OF THE INVENTION

The present invention relates to a method for printing on a plurality of sheets. The present invention further relates to an inkjet printing apparatus for printing on a plurality of sheets.

BACKGROUND ART

A known inkjet printing apparatus for printing on a plurality of sheets comprises a conveying belt unit and a print station comprising an inkjet print head assembly for applying droplets of ink on the sheets.

The conveying belt unit comprises a transport belt and several rollers arranged for transporting the endless transport belt in a conveying direction along the print station. The endless transport belt comprises a support surface for supporting the plurality of sheets during transport along the print station. The support surface comprises perforations arranged for allowing a suction force to hold each of the plurality of sheets on the support surface. A suction device is arranged comprising a vacuum chamber arranged for applying the suction force to the perforations of the support surface in order to attract each of the plurality of sheets on the support surface. A first sheet and a second sheet are arranged on the support surface at a standard sheet-to-sheet distance between one another. In the area of the sheet-to-sheet distance the perforations are not covered by the sheets.

During printing by the print head assembly, droplets of ink are applied on the sheet in order to form an image. The ink may be an aqueous ink and/or may be any other solvent containing ink. When droplets of an aqueous ink are applied on the sheet evaporation of the water component may occur, thereby increasing the humidity of the air present in a print region between the print head assembly and the support surface.

In case the moisture in the air becomes saturated in the print region, dew may form on one or more print heads of the print head assembly at a dew point depending on the temperature of the respective print head. Typically the temperature of the print heads is controlled to be substantially constant during printing in order to control the ink droplet formation. In any way, dew formation on the print head may disturb the ink droplet formation during printing, which leads to image defects.

It is known to detect a dew point of the air in the print region by measuring a temperature of the air and measuring the humidity of the air of the print region. Subsequently the temperature of the air in the print region may be increased and/or the air may be moved by an additional air conditioning unit in the print region in order to prevent dew formation on the print head assembly.

A disadvantage of this method is that, in order to prevent the dew formation on the print head assembly, sensors for measuring air temperature and air moisture are needed and the air conditioning unit is needed to move the air and/or heat the air in the print region in response to the sensed air temperature and air moisture.

SUMMARY OF THE INVENTION

It is accordingly an object of the present invention to provide a method for printing on a plurality of sheets in an inkjet printing apparatus comprising an endless conveyor for conveying the sheets along a print station, wherein dew formation is controlled in a simple way.

In an aspect of the invention a method is provided for printing on a plurality of sheets, the method comprising the steps of:

a) arranging the plurality of sheets on a support surface of an endless conveyor, the plurality of sheets including a first sheet and a second sheet being arranged at a sheet-to-sheet distance between one another;

b) advancing the plurality of sheets on the support surface in a conveying direction along a print head assembly for applying droplets of ink on the sheets;

c) providing a suction force through perforations arranged in the support surface for holding the plurality of sheets on the support surface, wherein the suction force provides an air flow through uncovered perforations present in the sheet-to-sheet distance in a print region between the print head assembly and the support surface;

d) forming an image by the print head assembly on each of the plurality of sheets supported on the support surface of the conveyor by applying droplets of ink;

wherein the method further comprises the step of:

e) controlling the sheet-to-sheet distance in response to a dew formation attribute for indicating dew formation on the print head assembly.

The perforations in the area of the sheet-to-sheet distance are not covered by the sheets. As a result a suction air flow is provided through the uncovered perforations in the print region between the print head assembly and the support surface, thereby partly removing and/or refreshing the air of the print region including removing moisture from the print region.

The sheet-to-sheet distance is controlled in the present invention, e.g. may be increased, in response to the dew formation attribute. By increasing the sheet-to-sheet distance between subsequent sheets the dew formation may be prevented and/or the air may be refreshed such that dew drops are removed from the print head assembly by increasing the evaporation rate of the water present on the print head assembly.

In fact, by refreshing the air in the print region, the relative humidity of the air in the print region may be reduced. As a result a dew point of the air in the print region may be reduced. The dew point is the temperature at which the water vapor in the air at constant air pressure condenses into liquid water at the same rate at which it evaporates.

The method provides a simple mechanism to control dew formation on the print head assembly, as the suction air flow provided by the uncovered perforations is easily controllable in the print region by the sheet-to-sheet distance, and because no additional air conditioning unit for providing an air flow is needed.

Furthermore the method provides the advantage that the air flow is easily controlled by the sheet-to-sheet distance to be substantially uniform across a width of the print head assembly perpendicular to the conveying direction.

The dew formation attribute according to the present invention is any attribute indicating dew formation on the print head assembly. As defined in the present invention, dew formation is a higher condensation rate than evaporation rate, which leads to dew drops being formed.

The dew formation attribute may be a print region property, may be a sheet property, may be an image property and may be any other suitable property for indicating dew formation on the print head assembly. In embodiments a combination of dew formation attributes may be used.

In the present invention the dew formation attribute may be an attribute indicating the presence of dew on the print head assembly, wherein the sheet-to-sheet distance is reactively adjusted in response to said dew formation attribute in order to remove, i.e. by increasing the evaporation rate, the dew already being present on the print head assembly. For example the dew formation attribute may be an image defect, which is indicative for the presence of dew on a print head of the print head assembly.

Alternatively in the present invention the dew formation attribute may be an attribute for predicting the formation of dew on the print head assembly, wherein the sheet-to-sheet distance is proactively adjusted in response to said dew formation attribute in order to prevent the dew formation on the print head assembly.

In an embodiment, the dew formation attribute is a sheet temperature of the first sheet and wherein, prior to step a), in step e) the sheet-to-sheet distance is based on the sheet temperature of the first sheet.

The speed of evaporation of the liquid, such as water, of the applied droplets of ink is depending on the sheet temperature. A saturation of the air in the print region may be predicted based on the sheet temperature, for example when the sheet temperature is considerably higher than a temperature of a print head of the print head assembly. The sheet-to-sheet distance may be proactively adjusted to prevent the dew formation on the print head assembly.

Another advantage of increasing the sheet-to-sheet distance is that, the first sheet may be cooled by the air flow in case that the air temperature in the print region is lower than the measured sheet temperature. In such case, the evaporation of the liquid from the sheet may even be reduced in response to the increased sheet-to-sheet distance. It is typically known in printing applications to condition the air temperature of the print region in order to control the printing process.

The first sheet may be arranged upstream of the second sheet and the first sheet may be arranged downstream of the second sheet with respect to the conveying direction.

Alternatively or additionally the dew formation attribute may be a sheet temperature of a third sheet of the plurality of sheets, which for example has been processed upstream of the first and second sheet, and the dew formation attribute may be an average sheet temperature of a plurality of sheets. In all of these embodiments, the sheet-to-sheet distance is based on the respective sheet temperature.

In an embodiment, the step e) further comprises the steps of:

f) determining a dew threshold temperature of the first sheet for dew formation on the print head assembly; and g) comparing the sheet temperature to the dew threshold temperature.

In step f) the dew threshold temperature of the first sheet may be selected to be substantially the same as a temperature of a print head of the print head assembly. Alternatively the dew threshold temperature may be selected based on a predetermined threshold temperature for dew formation on the print head assembly. Said predetermined threshold temperature may be predetermined during a calibration mode of the printing apparatus, wherein a temperature of the first sheet is varied.

In step g) a difference between the sheet temperature of the first sheet and the dew threshold temperature is determined. Depending on said difference, the sheet-to-sheet distance may be adjusted in step e).

In an embodiment, the sheet-to-sheet distance is selected to be substantially equal to a standard distance in case the sheet temperature is equal to or lower than the dew threshold temperature.

The standard distance may be a minimum sheet-to-sheet distance for maximum productivity of the printing apparatus. In case the sheet temperature is equal to or lower than the dew threshold temperature substantially no dew formation on the print head assembly is expected. The embodiment ensures a maximum productivity of printing in case no dew formation on the print head assembly is to be expected during printing.

In an embodiment, the sheet-to-sheet distance is adjusted higher relative to a standard distance based on the sheet temperature in case the sheet temperature is higher than the dew threshold temperature.

In case the sheet temperature is higher than the dew threshold temperature, dew formation on the print head assembly may be expected. In this embodiment the sheet-to-sheet distance is adjusted higher, i.e. increased, relative to the standard distance.

In another embodiment, the sheet-to-sheet distance is adjusted higher relative to a standard distance based on the sheet temperature in case the sheet temperature of a predetermined plurality of sub sequent sheets, including the first sheet, is higher than the dew threshold temperature.

For example, the first sheet is the last sheet of the predetermined plurality of sub sequent sheets in the conveying direction. In this example, the sheet-to-sheet distance is not adjusted, in case less than the predetermined plurality of sub sequent sheets has a sheet temperature higher than the dew threshold temperature. In this example dew formation on the print head assembly becomes a problem after a certain water vapor load of the predetermined plurality of sub sequent sheets has occurred.

The sheet-to-sheet distance is based on the sheet temperature. For example it is based on a temperature difference between the sheet temperature and the dew threshold temperature, wherein the sheet-to-sheet distance increases as function of said temperature difference, such as a linear and/or second order correlation to said temperature difference.

In an embodiment, the method further comprising, prior to step a), the step of:

h) determining a local print duty of a group of nozzles of the print head assembly for applying the droplets of ink in an area on the first sheet during the step d);

wherein the step e) further comprises the step of:

i) increasing the sheet-to-sheet distance based on the local print duty in case the local print duty is higher than a threshold duty.

A local print duty may be an important factor affecting dew formation on the print head assembly, as a lateral mixing of air in the print region is found to be rather slow. This embodiment prevents dew formation in response to the local print duty.

In step h) the local print duty may be a ratio or percentage of said area on which droplets of ink are applied by the group of nozzles. For example, in step h) the area may be a number of adjacent printing lines on the first sheet and the local print duty may be a ratio or percentage of said printing lines on which droplets of ink are applied by the group of nozzles. For example in a single pass printing mode, a number of adjacent printing lines may be printed in one pass by the group of nozzles of the print head assembly.

The group of nozzles may be constituted by nozzles of a first print head only, such as an array of nozzles of the first print head, and the group of nozzles may be constituted by nozzles of at least two print heads of the print head assembly.

The local print duty may be determined by an image processing unit based on digital image data for controlling the group of nozzles of the print head assembly for printing the image on the first sheet.

In step i) the sheet-to sheet distance is increased in case the local print duty is higher than the threshold duty. The threshold duty may be a percentage of the local print duty above which dew formation may locally occur at a print head, which is arranged downstream of the group of nozzles.

As the local print duty may be calculated before printing the image, the sheet-to sheet distance may be adjusted proactively to prevent the dew formation on the print head assembly.

In case the local print duty exceeds the threshold duty, the sheet-to-sheet distance is based on the local print duty. For example the sheet-to-sheet distance increases as function of said local print duty, such as a linear and/or second order correlation to said local print duty.

In an embodiment, the method further comprises the step of:

j) determining an ink coverage on the first sheet of the image forming step d);

wherein the step e) further comprises the step of:

k) increasing the sheet-to-sheet distance based on the ink coverage in case the ink coverage is higher than a threshold ink coverage.

In step j) the ink coverage on the first sheet is determined, for example by an image processing unit based on digital image data for controlling the print head assembly for printing the image on the first sheet.

In step k) the sheet-to sheet distance is increased in case the ink coverage exceeds the threshold ink coverage. The threshold ink coverage may be a percentage of the image area above which dew formation may occur at a print head of the print head assembly. As the ink coverage may be calculated before printing the image, the sheet-to sheet distance may be adjusted proactively to prevent the dew formation on the print head assembly.

In case the ink coverage exceeds the threshold ink coverage, the sheet-to-sheet distance is based on the ink coverage. For example the sheet-to-sheet distance increases as function of said ink coverage, such as a linear and/or second order correlation to said ink coverage.

In an embodiment, the step e) further comprises the step of selecting the dew threshold temperature based on a sheet attribute of the first sheet.

In a particular embodiment, the sheet attribute comprising at least one of a size of the first sheet and a sheet material of the first sheet.

The speed of evaporation of the liquid from the first sheet may be affected by the sheet attribute, such as the sheet material of the first sheet. As a result the dew threshold temperature, above which dew formation is expected, may be changed by the sheet attribute.

For example, the speed of evaporation may be lower, in case the material of a surface layer for receiving the droplets of ink provides a fast absorption of the droplets of the ink. It is typically known for coated media to provide a surface layer on the sheet in order to improve the ink absorption speed of the sheet.

Said sheet attribute may additionally or alternatively affect how the sheet-to-sheet distance is adjusted higher relative to a standard distance based on the sheet temperature in case the sheet temperature is higher than the dew threshold temperature.

In an embodiment, the step c) comprises adjusting the suction force based on the sheet temperature to increase the air flow in the print region between the print head assembly and the support surface in case the sheet temperature is higher than the dew threshold temperature.

In step c) the suction force may be increased to increase the air flow in the print region while maintaining a selected sheet-to-sheet distance. This provides the advantage that the productivity is maintained, while the dew formation is further reduced.

Another advantage is that cooling of the sheet and the support surface of the endless conveyor is enhanced by the air flow, in case the air temperature is lower than the sheet temperature. As a result also evaporation speed may be reduced, additional to removing moisture from the print region by the air flow.

In an embodiment, the plurality of sheets comprises a reference sheet, the dew formation attribute is an image defect and wherein, prior to arranging the first sheet and the second sheet during step a), in step e) the dew formation attribute is determined by the steps of:

l) forming an image on the reference sheet according to step d);

m) measuring the image formed on the reference sheet; and n) detecting image defects of the measured image.

In step l) the image is printed on the reference sheet by the print head assembly in the print region. The image may be a reference image for indicating nozzle failure of the nozzles of each print head of the print head assembly.

In step m) the image may be measured by an image sensor device, which is arranged downstream of the print head assembly in the conveying direction.

In step n) the image defect may be detected by comparing the measured image data with a previously measured image data and may be detected by comparing the measured image data with predicted image data derived from digital image data for controlling the print head assembly to print the image on the sheet.

The dew formation attribute is an image defect, which indicates dew formation on the print head assembly. For example, in case one or more nozzles fail to provide proper droplets of ink, it may be assumed that the cause of failure is dew formation on a nozzle plate of the respective print head.

The steps l), m), n) are carried out before determining the sheet-to-sheet distance between the first and second sheet. As such the reference sheet is processed upstream of the first sheet and second sheet in the conveying direction and before the first sheet and second sheet are arranged at the sheet-to-sheet distance on the support surface during step a).

In an embodiment, the step e) further comprises the step of:

o) receiving from an operator the dew formation attribute for controlling the sheet-to-sheet distance.

In step o) the dew formation attribute is received from the operator, such as by using a user interface (e.g. an input device). The dew formation attribute may be an acceptance level of a chance of dew formation. The acceptance level may be selected by the operator from a set of binary levels, e.g. a chance of dew formation and no chance of dew formation, or the acceptance level may be selected by the operator from a set of gradually levels, e.g. 0%, 25%, 50%, 75% and 100% chance of dew formation. The operator may select the acceptance level, which is the maximum level of chance of dew formation, which is allowed during forming the image by the print head assembly in step d). In step e) the sheet-to-sheet distance is controlled in order to reduce a chance of dew formation to a level, which is equal to or less than the acceptance level of chance of dew formation.

In a particular embodiment, the step e) further comprises the step of:

p) providing dew information to an operator, said dew information indicating a chance of dew formation; and wherein step o) is performed after step p) in response to the dew information provided in step p).

In step p) dew information may be provided to the operator by indicating the dew information on a user interface module, such as a display. The dew information indicates a chance of dew formation. In examples, the dew information may indicate a chance of dew formation expressed in a statistical percentage or expressed in a gradation level, such as the levels of low change, medium change and high change. By providing the dew information, the operator is given more information about the chance of dew formation, thereby supporting a decision whether he accepts the chance of dew formation.

Additionally, the dew information provided to the operator may further comprise an extend parameter of the dew formation. Said extend parameter may indicate the portion of the image, which may be affected by the dew formation. In an example, if dew formation may occur on less than 5% of the print head assembly, the extend parameter may indicate that up to 5% of the image may be affected.

Alternatively or additionally, the dew information provided to the operator may further comprise a risk parameter of the dew formation. The risk parameter may be derived from comparing the chance of dew formation with the visible effect on the image to be formed by the print head assembly during step d). In an example, if the image to be formed is not easily disturbed by dew formation (such as an image having a low ink coverage) and the chance of dew formation is low, the risk parameter may indicate that risk of the occurrence of the dew formation is low. On the other hand, if the image to be formed is easily disturbed by dew formation (such as an image having a high ink coverage) and the chance of dew formation is high, the risk parameter will indicate that risk of the occurrence of the dew formation is high.

Additionally, the operator may in step o) select an acceptance level of the chance of dew formation (i.e. as dew formation attribute) in response to the dew information provided.

In an aspect of the invention an inkjet printing apparatus is provided for printing on a plurality of sheets, comprising:

an endless conveyor comprising a support surface arranged for supporting the plurality of sheets, including a first sheet and a second sheet arranged at a sheet-to-sheet distance between one another, and conveying the sheets in a conveying direction along a print station;

the print station comprising a print head assembly arranged for applying droplets of ink on the plurality of sheets;

a suction device arranged for applying a suction force through perforations arranged in the support surface for holding the sheets on the support surface, wherein the suction force provides an air flow through uncovered perforations present in the sheet-to-sheet distance in a print region between the print head assembly and the support surface;

wherein the inkjet printing apparatus further comprises:

a distance control system configured for controlling the sheet-to-sheet distance on the support surface in response to a dew formation attribute for indicating dew formation on the print head assembly.

The distance control system controls the sheet-to-sheet distance on the support surface in response to the dew formation attribute. The distance control system may be connected to sensors for detecting the dew formation attributes, which in embodiments comprises print region properties, such as print head temperature, air temperature and/or air humidity and sheet properties, such as sheet temperature.

The distance control system may additionally or alternatively be connected to an image processing unit of the printing apparatus for receiving and processing image attributes, such as a predicted ink coverage of the image and a local print duty of a group of nozzles of a print head.

The distance control system may additionally or alternatively be connected to an image processing unit of the printing apparatus for receiving and processing detected image attributes, such as image defects determined based on an image measured by an image sensor.

In an embodiment, the distance control system is configured to drive a sheet feed device adapted for arranging the first and second sheet on the support surface at the determined sheet-to-sheet distance.

The sheet feed device may be a transport nip arranged upstream of the endless conveyor, may be a transport roller arranged facing the endless conveyor for controlling a translation of the sheet with respect to the support surface and may be any other device for arranging the first and second sheet on the support surface.

In an embodiment, the inkjet printing apparatus further comprises a sheet temperature system for determining a sheet temperature of the first sheet and the distance control system is configured for controlling the sheet-to-sheet distance based on the sheet temperature of the first sheet, the sheet temperature system preferably comprising a sensor for sensing the sheet temperature of the first sheet.

In a particular embodiment, the distance control system is configured to adjust the sheet-to-sheet distance higher relative to a standard distance based on the sheet temperature in case the sheet temperature of a predetermined plurality of sub sequent sheets, including the first sheet, is higher than the dew threshold temperature.

For example, the first sheet is the last sheet of the predetermined plurality of sub sequent sheets in the conveying direction. In this example, the sheet-to-sheet distance is not adjusted by the distance control system, in case less than the predetermined plurality of sub sequent sheets has a sheet temperature higher than the dew threshold temperature. In this example dew formation on the print head assembly becomes a problem after a certain water vapor load of the predetermined plurality of sub sequent sheets has occurred.

The sheet temperature system may be a part of distance control system. The sheet temperature system may determine the sheet temperature of the first sheet based on an external temperature, for example by assuming that the sheet temperature is substantially the same as the temperature of a sheet input module for storing a stack of sheets and supplying the sheets to the endless conveyor.

Alternatively or additionally the sheet temperature system may comprise a sensor for sensing the sheet temperature of the first sheet. Said sensor may be arranged upstream of the endless conveyor.

In an embodiment, the inkjet printing apparatus further comprises an image processing unit comprising a sensor device configured for measuring an image formed on a reference sheet by the print station and an image analyzing unit for detecting image defects of the measured image, said image defects indicating dew formation on the print head assembly; and wherein the distance control system is configured for controlling the sheet-to-sheet distance based on the image defects detected by the image analyzing unit.

Said image defects indicate dew formation on the print head assembly. For example, the image may be a reference image for the print heads of the print station. Furthermore, when it is determined from the reference image that one or more nozzles fail to provide proper droplets of ink, it may be assumed that the cause of failure is dew formation on a nozzle plate of the respective print head.

The sensor device may be an array of photosensors, such as in a charge coupled device (CCD) sensor or a full width array sensor. Said sensor device may be arranged downstream of the print station for measuring images formed by the print station.

The image analyzing unit may detect the image defect by comparing the measured image data with a previously measured image data and may detect the image defect by comparing the measured image data with predicted image data. Said predicted image data may be received from an image processing unit based on digital image data for controlling the print head assembly for printing the image on the first sheet.

In an embodiment, the inkjet printing apparatus further comprising a duplex transport path for circulating the sheets along a drying device back to the print station, which drying device is arranged for drying the sheets before a second pass of the sheets along the printing station, the inkjet printing apparatus preferably further comprising a cooling device arranged along the duplex transport path between the drying device and the print station, which cooling device is arranged for cooling the sheets before the second pass of the sheets along the printing station.

The duplex transport path enables both simplex printing and duplex printing on the sheets. Typically, in case the sheet is dried by the drying device and circulated back to the printing station, the sheet temperature may be increased due to heating in the drying device.

The cooling device is arranged in order to reduce the temperature of the sheets before the second pass of the sheets along the printing station. In case the sheet temperature of a sequence of duplex sheets is found to be too high, the sheet-to-sheet distance of subsequent sheets may be increased directly or may be increased after each sheet of a predetermined sequence of sheets has a too high sheet temperature, while the cooling device is activated to better cool the sequence of sheets being circulated. After the cooling of the sheets by the cooling device is amplified and the sheet temperature of succeeding sheets is reduced, the sheet-to-sheet distance may be reset to a standard (minimal) sheet-to-sheet distance. This provides a better control on prevention of dew formation.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1:
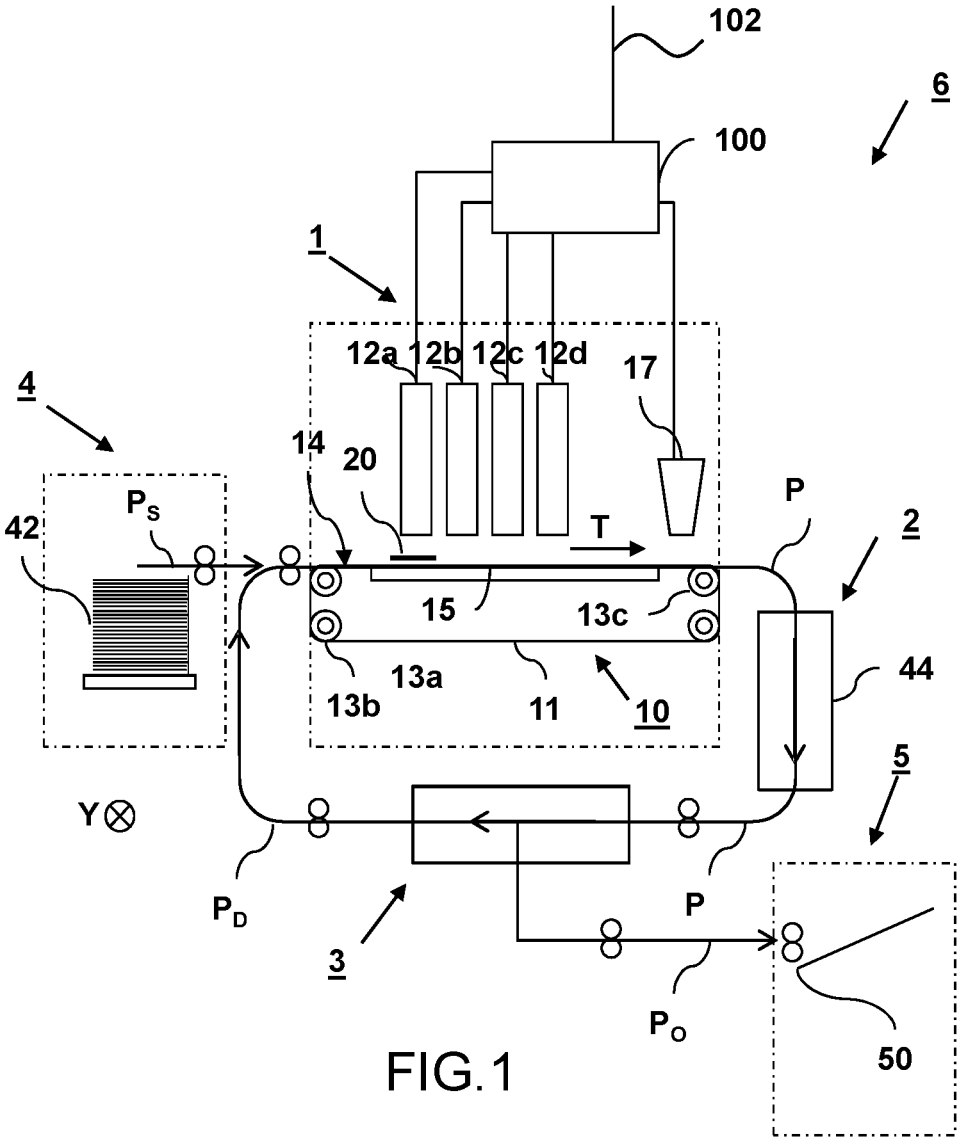
FIG. 1 shows a schematic view of a print engine in which a method according to the invention may be used.

The present invention will now be described with reference to the accompanying drawings, wherein the same reference numerals have been used to identify the same or similar elements throughout the several views.

In FIG. 1 an inkjet printing system 6 is shown. The inkjet printing system 6 comprises an inkjet print station 1, an inkjet print drying module 2, a sheet cooling module 3 and a controller 100. The controller is connected to a network through a network cable 102. The print data enters the controller 100 through the network 102 and is further processed. The print data can be saved on a non-volatile memory like a hard disk and sent to the inkjet marking module 1 using an interface board.

A cut sheet supply module 4 supplies a receiving medium 20 to the inkjet marking module 1 via a supply paper path $P_s$. In the cut sheet supply module 4 the receiving medium 20 is separated from a pile 42 and brought in contact with a transport belt 11, at its support surface 14, of a supplying conveyor 10 of the inkjet print station 1. The supplying conveyor further comprises an assembly of belt rollers 13.

The inkjet print station 1 comprises an assembly of four color inkjet print heads 12*a*-12*d*. The transport belt 11 transports the receiving medium 20 to the print region beneath the four color inkjet print heads 12*a*, 12*b*, 12*c*, 12*d*. The colors provided by the inkjet print heads 12 is black, cyan, magenta and yellow. When receiving the print data, the inkjet print heads 12 each generate droplets of inkjet marking material, such as an aqueous ink, and position these droplets on the receiving medium 20.

The transport belt 11 is transported by the assembly of belt rollers 13. The transport belt 11 is transported by one roller belt roller 13*a* in the conveying direction of T, and the position of the transport belt 11 in the transverse direction y is steered by means of another belt roller 13*b*. The transport belt 11 comprises perforations or holes and the receiving medium 20 is held in close contact with the support surface 14 of said belt 11 by means of an air suction device 15, which is arranged for providing a suction force through the perforations for holding the receiving medium 20 on the support surface 14.

After the inkjet marking material has been printed on the receiving medium 20, the receiving medium 20 is moved to an area beneath a scanner module 17. The scanner module 17 determines the position of each of the four color images on the receiving medium 20 and sends this data to the controller 100.

The receiving medium 20 is transported further from the supplying conveyor 10 via a paper path P towards an inkjet print drying module 2. The receiving medium 20 is dried in inkjet print drying module 2, for example by means of a heating plate 44, thereby evaporating the liquid of the inkjet marking material. The receiving medium 20 is transported further along the paper path P from the inkjet print drying module 2 to the sheet cooling module 3, wherein the receiving medium 20 is cooled.

From the cooling module 3 the receiving medium 20 is either moved towards the print storage module 5 or is moved along a duplex paper path $P_D$ back towards the supplying conveyor 11 for a second pass of the receiving medium 20 along the print station 1 for providing a second image on an opposite side of the receiving medium 20.

In case the receiving medium 20 is moved along the output transport path $P_O$ to the print storage module 5, the dried print product is made available on a tray 50 in the print storage module 5.

Figure 2A:
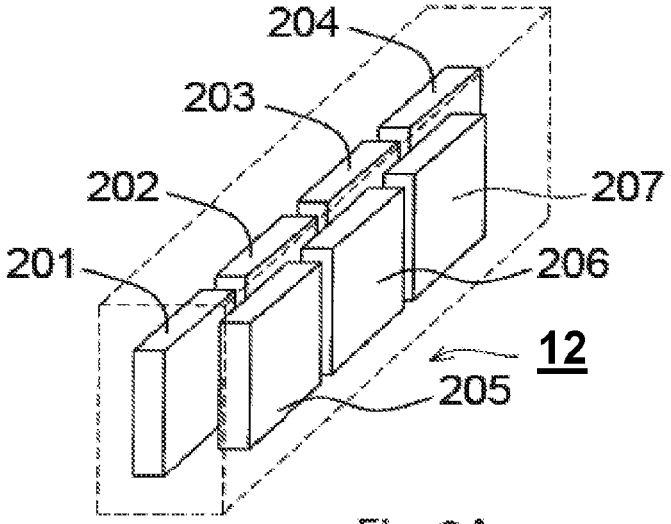
FIGS. 2A-2C is a schematic perspective view of an image forming device in the printing system of FIG. 1.
Figure 2B:
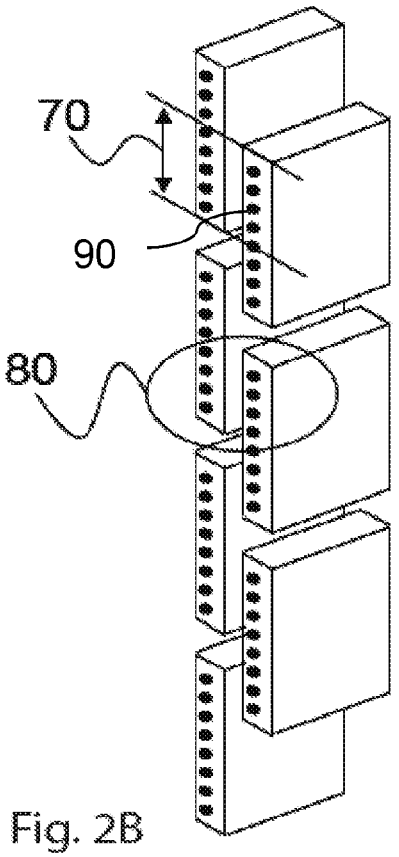
Figure 2C:
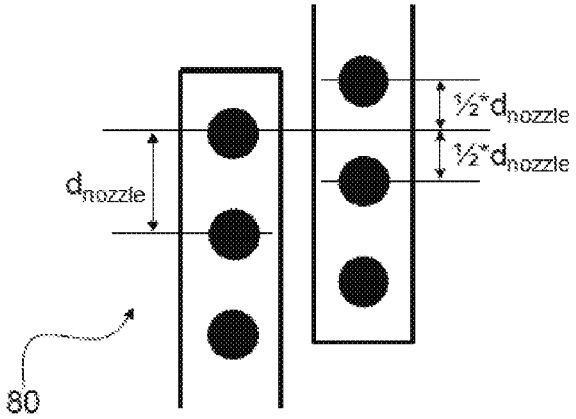

Now referring to FIGS. 2A-2C showing examples of the inkjet print heads 12. The inkjet print station 1 comprises an inkjet marking module having four inkjet marking devices 12*a*-12*d* each being configured and arranged to eject an ink of a different colour (e.g. Cyan, Magenta, Yellow and Black). Such an inkjet marking device 12*a*-12*d* for use in single-pass inkjet printing typically has a length corresponding to at least a width of a desired printing range, with the printing range being in the transverse direction Y perpendicular to the conveying direction T along the transport path P.

Each inkjet marking device 12*a*-12*d* may have a single print head having a length corresponding to the desired printing range. Alternatively, as shown in FIG. 2A, the inkjet marking device 12 may be constructed by combining two or more inkjet heads or printing heads 201-207, such that a combined length of individual inkjet heads covers the entire width of the printing range. Such a construction of the inkjet marking device 12 is termed a page wide array (PWA) of print heads. As shown in FIG. 2A, the inkjet marking device 12 (and the others may be identical) comprises seven individual inkjet heads 201-207 arranged in two parallel rows, with a first row having four inkjet heads 201-204 and a second row having three inkjet heads 205-207 arranged in a staggered configuration with respect to the inkjet heads 201-204 of the first row. The staggered arrangement provides a page-wide array of inkjet nozzles 90, which nozzles are substantially equidistant in the length direction of the inkjet marking device 12.

The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed.

Figure 3A:
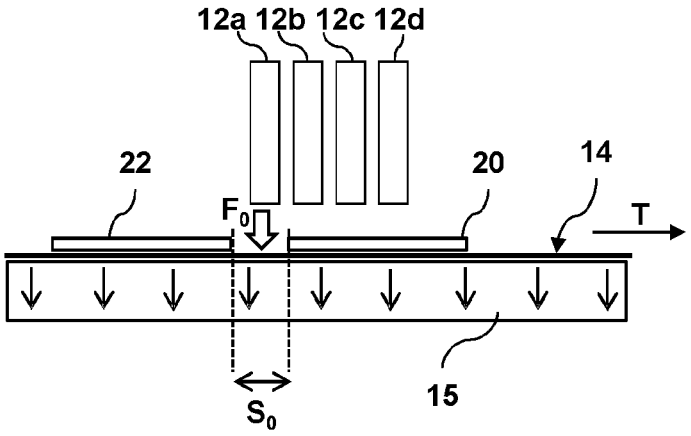
FIGS. 3A and 3B is a schematic side view of an embodiment of the method according to the present invention.
Figure 3B:
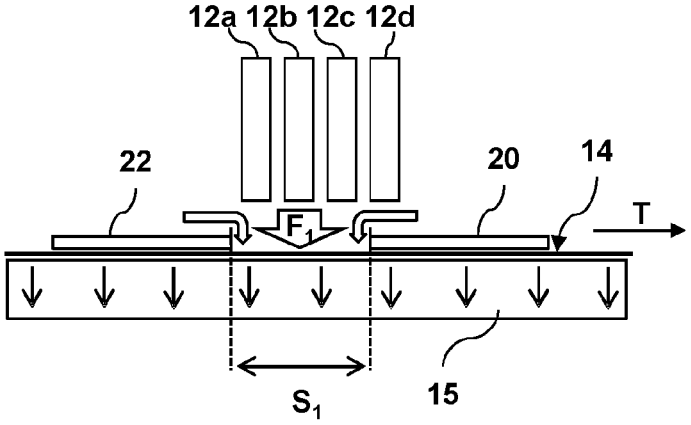

Now referring to FIGS. 3A and 3B an embodiment is shown of the method according to the present invention. In FIG. 3A an enlarged side view is shown of a normal mode of the inkjet print station 1. In FIG. 3A is shown the supplying conveyor 10, including the support surface 14 of the endless transport belt 11 and the air suction device 15, and the print head assembly 12*a*-12*d* of the inkjet print station 1.

The transport belt 11 is transported in a conveying direction T along the print head assembly 12*a*-12*d* and the stationary suction device 15 by the belt rollers 13 (not shown). A first sheet 20 and a second sheet 22 are arranged on the support surface 14 of the transport belt 11 at a standard sheet-to-sheet distance $S_0$ between the first sheet 20 and second sheet 22. Both sheets are conveyed in the conveying direction T along with the conveying direction T of the transport belt 11.

The standard sheet-to-sheet distance $S_0$ is a predetermined minimal sheet-to-sheet distance for transporting the sheets along the print head assembly 12*a*-12*d* and forming images on each sheet 20, 22 by applying droplets of ink on an imaging surface of each sheet 20, 22. The imaging surface of the sheets 20, 22 face the print head assembly 12*a*-12*d* during the transport along the print head assembly 12*a*-12*d*.

The transport belt 11 comprises perforations for providing a suction force provided by the suction device 15 at the support surface 14 for attracting and holding the sheets 20, 222 at its support surface 14. The suction force provides a standard air flow $F_0$ through uncovered perforations, which are present in the standard sheet-to-sheet distance $S_0$ in between the first sheet 20 and second sheet 22. The standard air flow $F_0$ removes air from the print region between the print head assembly 12*a*-12*d* and the support surface 14. As the sheet-to-sheet distance $S_0$ moves along the print head assembly 12*a*-12*d* along with the transport of the sheets 20, 22 all the print region is reached by the air flow $F_0$ in the conveying direction T.

In FIG. 3B an example is shown of a dew prevention mode of the embodiment according the present invention.

During printing by the print head assembly 12*a*-12*d*, droplets of ink are applied on the sheet 20, 22 in order to form an image. The ink may be an aqueous ink and/or may be any other solvent containing ink. When droplets of an aqueous ink are applied on the sheet 20, 22 evaporation of the water component may occur, thereby increasing the humidity of the air present in a print region between the print head assembly 12*a*-12*d* and the support surface 14.

In case the moisture in the air becomes saturated in the print region, dew may form on one or more print heads 12*a*-12*d* of the print head assembly at a dew point depending on the temperature of the respective print head 12*a*-12*d*. Typically the temperature of the print heads 12*a*-12*d* is controlled to be substantially constant during printing in order to control the ink droplet formation. In any way, dew formation on the print head may disturb the ink droplet formation during printing, which leads to image defects.

In this embodiment in the dew prevention mode it is determined based on a dew formation attribute that dew formation on the print head assembly may occur.

In the dew prevention mode of the inkjet print station 1, the first sheet 20 and a second sheet 22 are arranged on the support surface 14 of the transport belt 11 at a first sheet-to-sheet distance $S_1$ between the first sheet 20 and second sheet 22. the first sheet-to-sheet distance $S_1$ is selected to be higher than the standard sheet-to-sheet distance $S_0$ in response to the dew formation attribute for indicating dew formation on at least one print head of the print head assembly 12*a*-12*d*. Said dew formation attribute may be any attribute indicating dew formation on the print head assembly 12*a*-12*d*.

Said dew formation attribute may, for example, be a sheet temperature of the first sheet 20. When droplets of ink are applied on the first sheet 20, evaporation speed of the water component of the ink is driven by the sheet temperature of the first sheet 20. In case, for example, the sheet temperature is lower than a temperature of the print heads of the print head assembly 12*a*-12*d*, the water vapor in the print region between the print head assembly 12*a*-12*d* and the support surface 14 will preferably form dew on the sheets 20, 22 instead of on the print heads. However, in case the sheet temperature is higher than a temperature of the print heads of the print head assembly 12*a*-12*d*, the water vapor in the print region will preferably form dew on the print heads 12*a*-12*d*.

In the dew prevention mode, the suction force provided by the suction device 15 provides a first air flow $F_1$ through uncovered perforations, which are present in the first sheet-to-sheet distance $S_1$ in between the first sheet 20 and second sheet 22. The first air flow $F_1$, for example expressed in terms of air ventilation rate, is higher than the standard air flow $F_0$ in the normal mode. As a result the water vapor in the air of the print region is increasingly removed with respect to the normal mode of the inkjet print station 1. In this way dew formation may be prevented by removing the water vapor from the print region, thereby increasing the evaporation rate of water being present on the print head assembly 12*a*-12*d*.

Typically the air environment around the print head assembly 12*a*-12*d* may be conditioned to have substantially a predetermined relative humidity, such as 50%-70% relative humidity. Thus, by removing the air in the print region by way of the air suction through said uncovered perforations (as indicated by arrows $F_0$, $F_1$), the air in the print region is refreshed by the air environment, which is in fluid communication to the print region.

Figure 4:
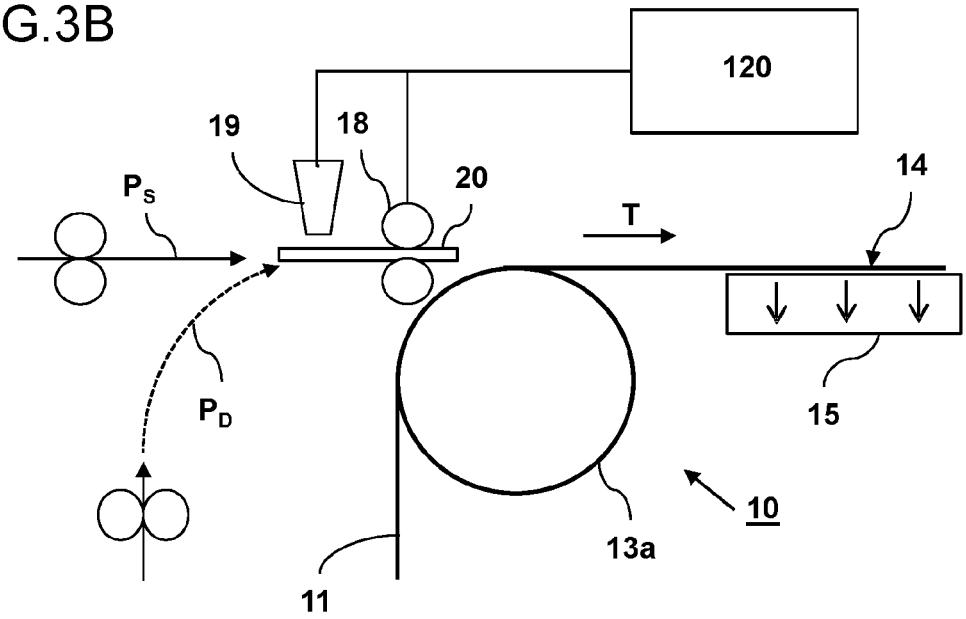
FIG. 4 shows an enlarged side view of FIG. 1 according to an embodiment of the present invention.

Now referring to FIG. 4 wherein an embodiment is shown of the present invention. In FIG. 4 is shown an enlarged side view of FIG. 1 of the supply paper path $P_s$, the entrance side of the supply conveyor 10 and the duplex paper path $P_D$. Sheets 20 may be supplied to the supply conveyor 10 from either the supply paper path $P_s$ or the duplex paper path $P_D$. In FIG. 4 the transport belt 11, comprising the support surface 14, and the driving roller 13*a* of the supplying conveyor 10 and the air suction device 15 are shown. The transport belt 11 is transported in the conveying direction T by the driving roller 13*a*.

At the entrance side of the supplying conveyor 10, a sheet feed nip 18 and a temperature sensor 19 are arranged upstream of the transport belt 11. The sheet feed nip 18 is arranged for arranging the first sheet 20 on the support surface 14 of the transport belt 11. The sheet feed nip 18 is connected to a distance control system 120, which is configured for controlling the sheet feed nip 18 to control a sheet-to-sheet distance between the first sheet 20 and a subsequent second sheet on the support surface 14 (not shown).

The temperature sensor 19 is arranged for measuring the temperature of the first sheet 20 upstream of the sheet feed nip 18. The temperature sensor 19 is operatively connected to the distance control system 120 to provide the signal of the sensed sheet temperature to the distance control system 120. In this embodiment, the distance control system 120 is configured to determine the sheet-to-sheet distance in response to the sheet temperature sensed by the temperature sensor 19. The temperature sensor 19 is arranged to sense any sheets coming from the supply paper path $P_s$ and from the duplex paper path $P_D$.

Alternatively, the distance control system 120 may be configured to determine the sheet-to-sheet distance based on a running average of the sheet temperature of a sequence of sheets being transported along the temperatures sensor 19.

Figure 5A:
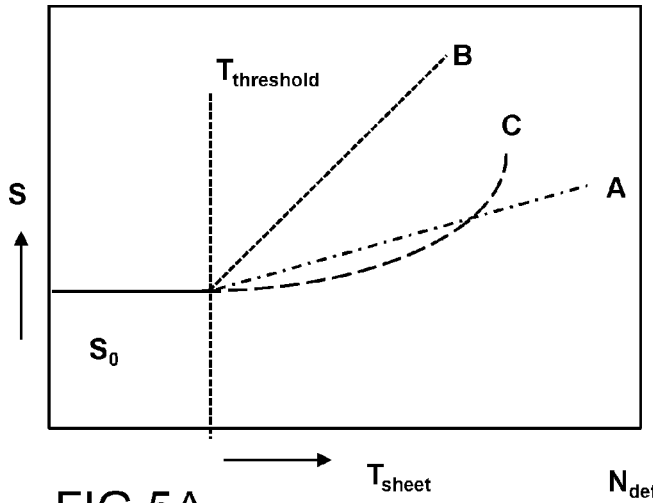
FIGS. 5A-5C shows a distance control algorithm according to an embodiment of the present invention.
Figure 5C:
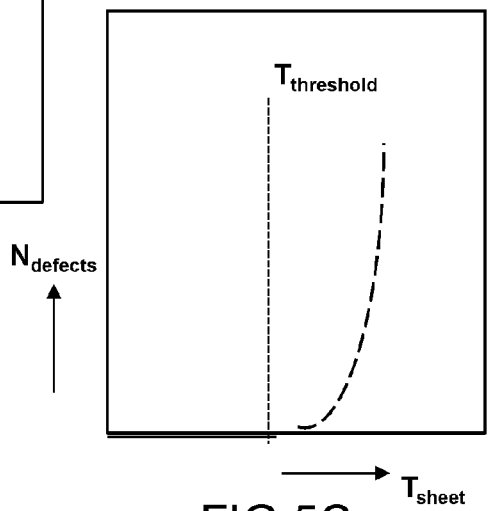
Figure 5B:
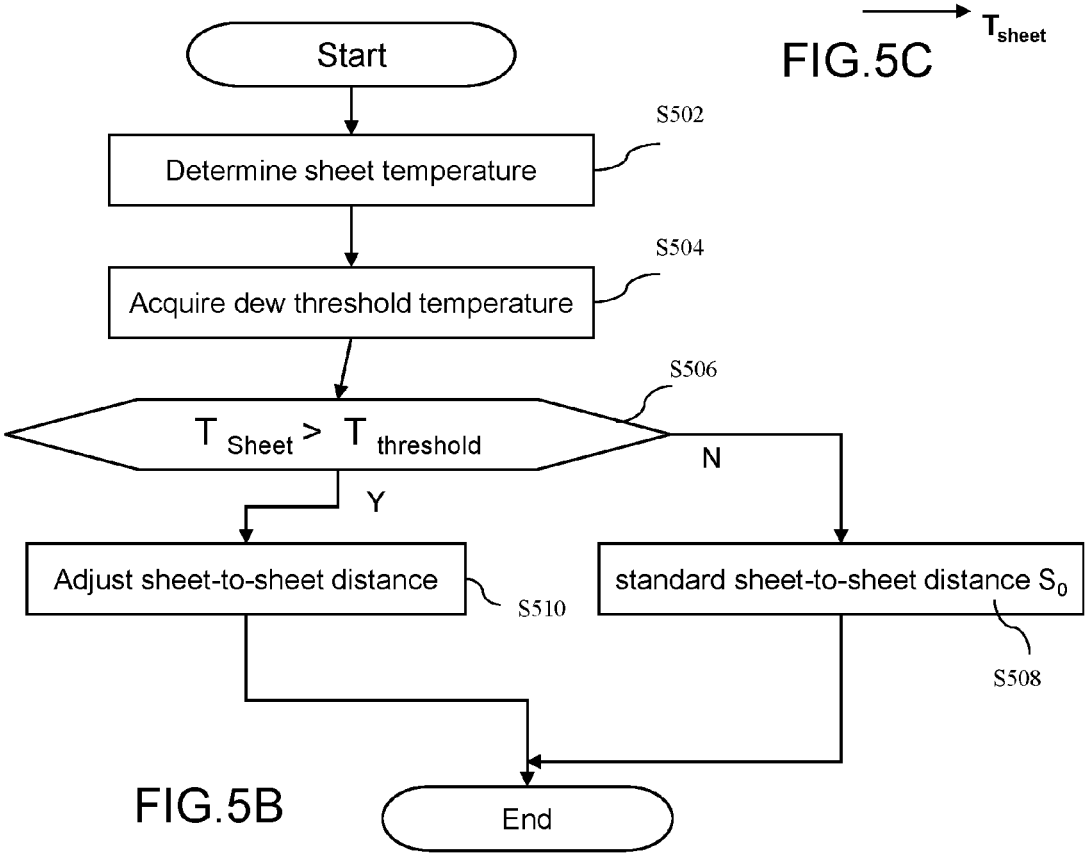

Now referring to FIGS. 5A-5C wherein another embodiment is shown of the present invention. In FIG. 5A a control diagram is shown of distance control algorithm performed by the distance control system 120 (shown in FIG. 4) for controlling the sheet-to-sheet distance S between a first sheet 20 and the second sheet 22 based on a sheet temperature $T_{sheet}$ of the first sheet 20.

In FIG. 5B a flow diagram is shown of the distance control algorithm performed by the distance control system 120. In this embodiment in step S502 the sheet temperature of the first sheet 20 is determined by the temperature sensor 19 and is received by the distance control system 120. In step S504 the dew threshold temperature is acquired by the distance control system 120. For example the controller 100 may provide the dew threshold temperature to the distance control system 120 based on a calibration mode carried out earlier for determining the dew threshold temperature.

In step S506 the sheet temperature is compared with the dew threshold temperature and it is determined whether the sheet temperature is higher than the dew threshold temperature. In case no, in step S508 the sheet-to-sheet distance is selected to be equal to a standard sheet-to-sheet distance $S_0$ as shown in FIG. 3A. The dew threshold temperature $T_{threshold}$ in this embodiment is set equal to a print head temperature of the print head assembly 12*a*-12*d*, which for example is controlled to be 35° C. constantly.

In case yes, in step S510 the sheet-to-sheet distance S is increased relative to the standard sheet-to-sheet distance $S_0$. For example, the sheet-to-sheet distance S linearly increases as shown by the line A as function of the sheet temperature $T_{sheet}$. By increasing the sheet-to-sheet distance S relative to the standard sheet-to-sheet distance $S_0$, dew formation is prevented by increasing the air suction flow as shown in FIG. 3B.

The dew threshold temperature $T_{threshold}$ acquired in step S504 may alternatively be determined based on a sheet attribute of the first sheet 20, such as based on a sheet material of the first sheet 20 or a surface coating of the first sheet 20. Said surface coating or sheet material may affect the speed of evaporation of the water from the imaging surface of the first sheet 20. For example, if the surface coating contains components for actively absorbing and retaining water, the speed of evaporation of water may be much slower. As a result the dew threshold temperature may be selected higher than the print head temperature of the print head assembly 12*a*-12*d* based on said sheet attribute.

The dew threshold temperature $T_{threshold}$ acquired in step S504 may be determined experimentally for a certain sheet in a calibration mode. In said calibration mode a sequence of said sheets 20 is processed in the inkjet print station 1 using the standard sheet-to-sheet distance $S_0$ shown in FIG. 3A, thereby forming on each sheet a predetermined reference image. The reference image may be a standard image having relatively high ink coverage.

As shown in FIG. 5C, the sheet temperature of sub sequent sheets is varied in the calibration mode, e.g. increased stepwise after a predetermined sequence of sheets having the same sheet temperature, and the sheet temperature $T_{sheet}$ at which dew formation occurs on the print head assembly is determined. The dew formation is determined by measuring each image using the scanner module 17 (shown in FIG. 1). The scanner module 17 sends image data to the controller 100. The controller 100 detects image defects, for example by comparing the received image data with respect to predetermined image data of a previous scan. Based on image defects increasing rapidly at a certain sheet temperature of a sequence of sheets and above said sheet temperature (as shown in FIG. 5C), the dew threshold temperature is determined.

In any of these embodiments, as shown in FIG. 5A, in case the sheet temperature $T_{sheet}$ is above the dew threshold temperature $T_{threshold}$, according to step S510 the sheet-to-sheet distance S is increased relative to the standard sheet-to-sheet distance $S_0$.

In another example of step S510, the sheet-to-sheet distance S linearly increases as shown by the line B as function of the sheet temperature $T_{sheet}$ as shown in FIG. 5A. The linear increment of line B is higher than of line A as function of the sheet temperature $T_{sheet}$. The line B may be selected instead of line A based on a sheet attribute, for example if the sheet material and/or surface coating provides a higher evaporation speed at a certain sheet temperature $T_{sheet}$.

In a third example of step S510, the sheet-to-sheet distance S increases as shown by the line C as function of the sheet temperature $T_{sheet}$ in a second order relation as shown in FIG. 5A. The non-linear increment of line C starts lower than line A, but further on rapidly increases higher than line A as function of the sheet temperature $T_{sheet}$. The line C may be more consistent with a evaporation rate dependency on sheet temperature $T_{sheet}$. Furthermore the sheet-to-sheet distance according to line C stays relatively constant just above the dew threshold temperature $T_{threshold}$, thereby supporting the productivity of the printing process.

Additionally or alternatively to increasing the sheet-to-sheet distance S above the dew threshold temperature $T_{threshold}$, the controller 100 may be configured to adjust the suction force provided by the air suction device 15 based on the sheet temperature $T_{sheet}$. For example, by increasing the suction force the suction air flow $F_0$, $F_1$ in the print region may be increased while maintaining the selected sheet-to-sheet distance $S_0$, $S_1$ as shown in FIG. 3A or FIG. 3B. This provides the advantage that the productivity is maintained, while the dew formation is further reduced due to the increased suction air flow $F_0$, $F_1$. Another advantage is that the air flow may enhance active cooling of the sheets 20, 22 and of the support surface 14, in case the air temperature in the print region is lower than the sheet temperature $T_{sheet}$.

Additionally, in case the sheet temperature is determined higher than the dew threshold temperature $T_{threshold}$ and the sheets are supplied via the duplex paper path $P_D$, the controller 100 may send a signal to the sheet cooling module 3, to enhance the cooling of sheets in the sheet cooling module 3. As a result, the sheet temperature $T_{sheet}$ of later sheets provided from the sheet cooling module 3 via the duplex paper path $P_D$ to the inkjet print station 1 is reduced. In a next step the sheet-to-sheet distance S is reduced back to the standard sheet-to-sheet distance $S_0$, in case the sheet temperature $T_{sheet}$ of later sheets is dropped below the dew threshold temperature $T_{threshold}$ again. This method of prevention of dew formation is based on a fast control on the sheet-to-sheet distance S on the transport belt 11 and a slow control on the sheet temperature $T_{sheet}$ of sheets in the duplex paper path.

Figure 6A:
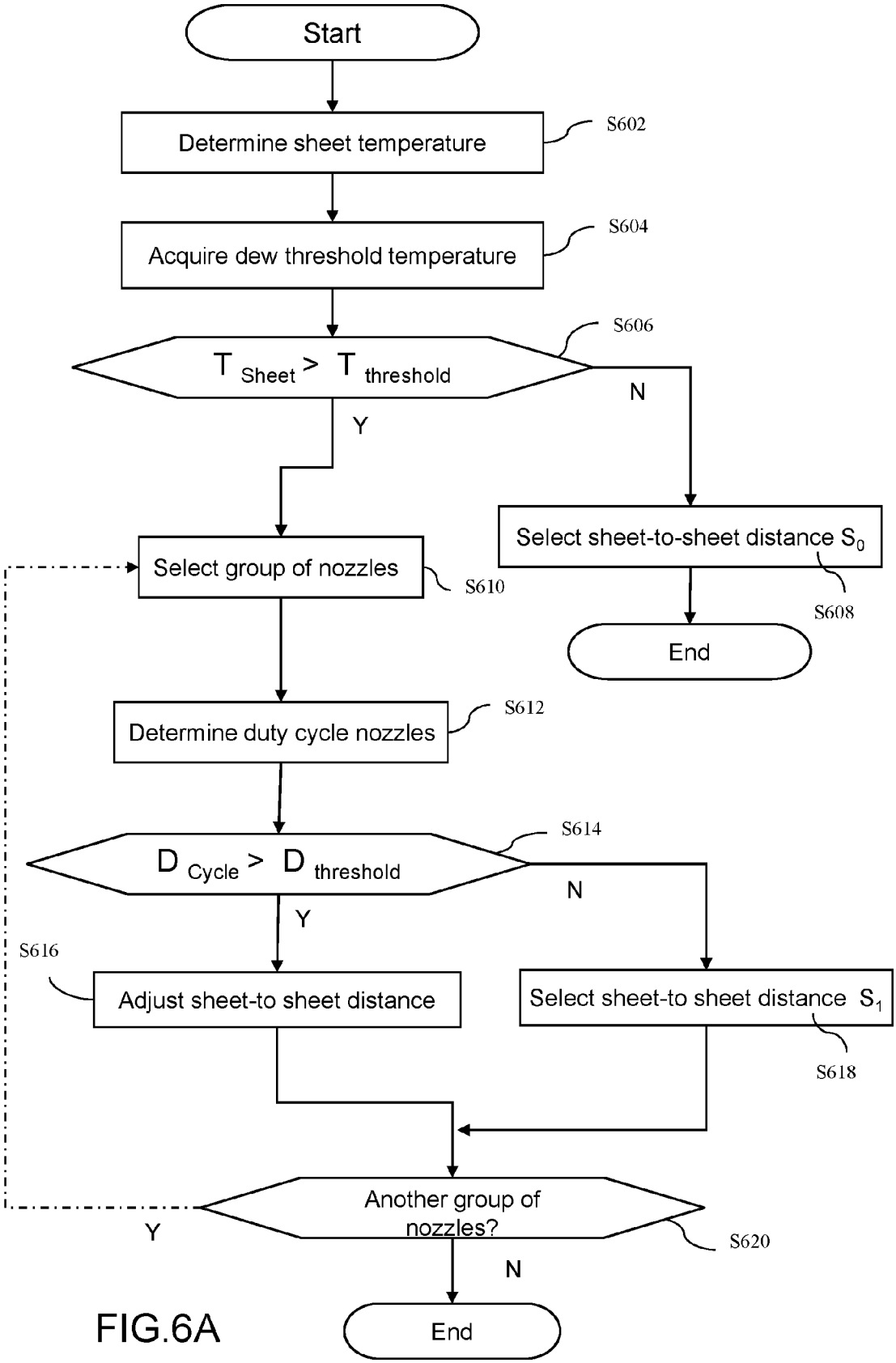
FIGS. 6A-6C shows another distance control algorithm according to an embodiment of the present invention.
Figure 6B:
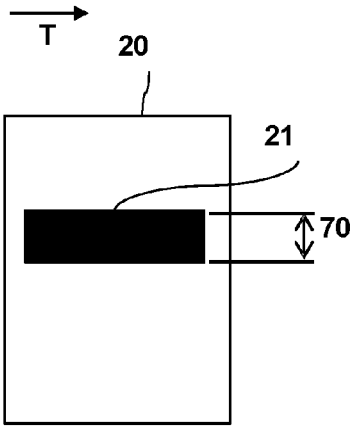
Figure 6C:
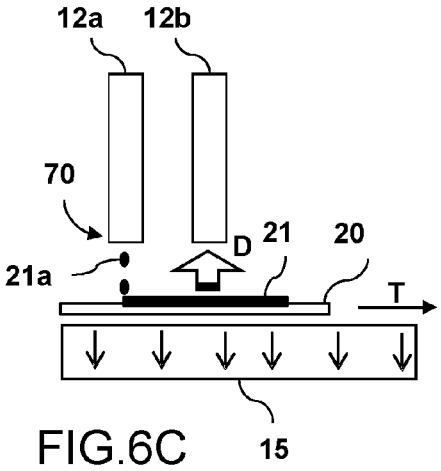

Now referring to FIGS. 6A-6C showing an embodiment of a distance control algorithm for dew control according to the present invention.

In FIG. 6A a flow diagram is shown of the distance control algorithm performed by the distance control system 120 shown in FIG. 4. In this embodiment in step S602 the sheet temperature of the first sheet 20 is determined by the temperature sensor 19 and is received by the distance control system 120. In step S604 the dew threshold temperature is acquired from the controller 100. For example the controller 100 may provide the dew threshold temperature based on a calibration mode carried out earlier for determining the dew threshold temperature.

In step S606 the sheet temperature is compared with the dew threshold temperature and it is determined whether the sheet temperature is higher than the dew threshold temperature. In case no, in step S608 the sheet-to-sheet distance is selected to be equal to a standard sheet-to-sheet distance $S_0$.

In case yes, in step S610 a group of nozzles is selected from the print head assembly 12*a*-12*d*. For example the selected group of nozzles is an array of adjacent nozzles of printhead 12*a* extending over a certain width in a transverse direction 70 (as shown in FIG. 6B), such as the two staggered print heads 204, 207 arranged in two rows of nozzles, which extend over a distance 70 of the printing range as shown in FIG. 2B. The array of adjacent nozzles 70 is arranged for printing a plurality of adjacent printing lines 21 on the sheet 20 in the conveying direction of the sheet T as shown in FIG. 6B and FIG. 6C. FIG. 6C is a cross sectional view of the sheet 20 and the print head assembly 12*a*, 12*b* along the conveying direction T at the array of adjacent nozzles 70 for printing the printing lines 21.

In step S612 the local duty cycle of the selected group of nozzles 70 is determined. As shown in FIG. 6B the array of nozzles 70 is to be actuated substantially continuously for forming the image 21 on the sheet 20 as the sheet 20 is transported along the black print head 12*a*. Thus the local duty cycle of the array of nozzles 70 on the sheet 20 is 90% as 90% of the area of the printing lines 21 is covered by droplets of ink 21*a* in the conveying direction T. In step S612 the local duty cycle is determined by the controller 100 based on digital image data for controlling the nozzles of black print head 12*a*. Thus the local duty cycle of the group of nozzles is determined in step S612 prior to applying the droplets of ink on the sheet 20 and prior to arranging the sheet 20 on the transport belt 11.

In step S614 it is determined whether the local duty cycle of the group of nozzles is higher than a threshold duty. The threshold duty is a percentage of the local duty cycle above which dew formation may occur on any print head 12*b*-12*d* downstream of the black print head 12*a* in the conveying direction T (for example print head 12*b* as indicated by the arrow D in FIG. 6C) In this example the threshold duty $D_{threshold}$ is determined by the distance control system 120 to be 50%.

In case no, no dew formation is to be expected on any print head downstream of the array of nozzles 70 in response to the local duty cycle of the group of nozzles 70, and a sheet-to-sheet distance $S_1$ is selected based on the sheet temperature $T_{sheet}$.

In case yes, dew formation is to be expected in response to the local duty cycle of the group of nozzles 70, and the sheet-to-sheet distance S is further increased relative to $S_1$, which is merely based on the sheet temperature $T_{sheet}$ (thus S selected>$S_1$).

In step S620 it is decided, whether another group of nozzles is to be analysed. In case yes, the steps S610-S620 are iterated in regards of said other group of nozzles. In case no, the distance control algorithm is ended.

In this distance control algorithm, in case any of the local duty cycles of a certain group of nozzles exceeds the duty threshold during one of these iterations, the sheet-to-sheet distance is selected to be higher than the sheet-to-sheet distance $S_1$. The sheet-to-sheet distance may be selected based on the maximum of the local duty cycles determined in the iterated steps S612 carried out.

In this example the local duty cycle 90% of the array of nozzles 70 was the maximum of the local duty cycles determined for all groups of nozzles. Accordingly the sheet-to-sheet distance is adjusted based on the local duty cycle of 90% in order to prevent local dew formation due to the duty cycle of the group of nozzles 70.

The distance control algorithm of FIG. 6A may be applied by the distance control system 120 for all print heads 12*a*-12*c*, which are arranged upstream of another print head in the conveying direction. The control algorithm of FIG. 6A may also be applied to the last print heads 12*d* in the conveying direction T as dew formation may even occur at the print head itself, which provides the local duty cycle.

The group of nozzles may also be constituted by more than one print head 12*a*-12*d* over a certain width of the printing range transverse of the conveying direction T, as the sum of all the droplets of ink applied by these print heads in a certain area may provide local dew formation on another print head over said width downstream of said group of nozzles.

Figure 7:
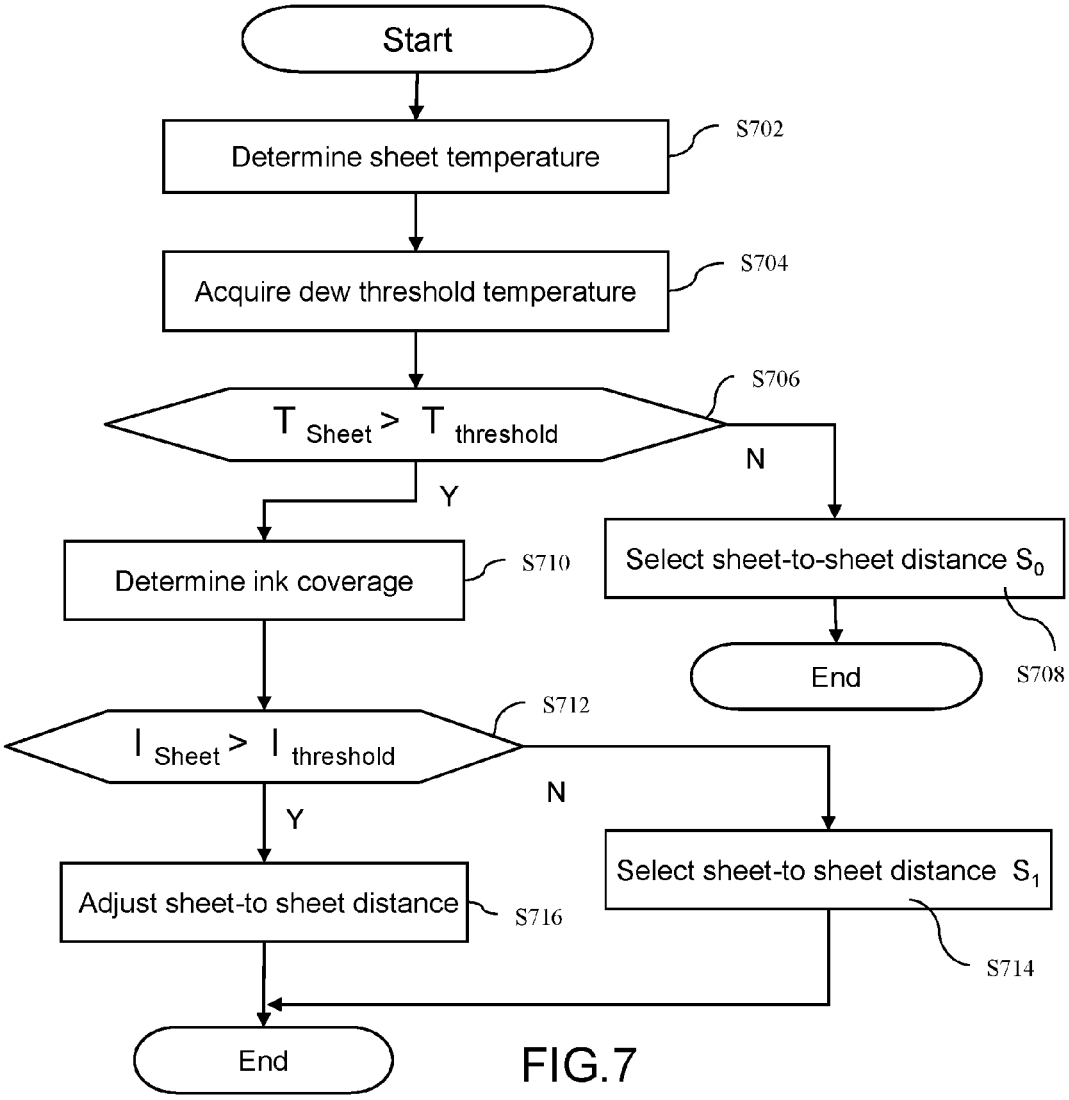
FIG. 7 shows another distance control algorithm according to an embodiment of the present invention.

Now referring to FIG. 7 showing an embodiment of a distance control algorithm for dew control according to the present invention.

In FIG. 7 a flow diagram is shown of the distance control algorithm performed by the distance control system 120 shown in FIG. 4. In this embodiment in step S702 the sheet temperature of the first sheet 20 is determined by the temperature sensor 19 and is received by the distance control system 120. In step S704 the dew threshold temperature is acquired from the controller 100. For example the controller 100 may provide the dew threshold temperature based on a calibration mode carried out earlier for determining the dew threshold temperature.

In step S706 the sheet temperature is compared with the dew threshold temperature and it is determined whether the sheet temperature is higher than the dew threshold temperature. In case no, in step S708 the sheet-to-sheet distance is selected to be equal to a standard sheet-to-sheet distance $S_0$.

In case yes, in step S710 an overall ink coverage $I_{sheet}$ is determined for the image formed on the sheet 20. The ink coverage $I_{sheet}$ is determined by the controller 100 based on digital image data for controlling the print head assembly 12*a*-12*d* for forming the image. Thus the ink coverage $I_{sheet}$ is determined in step S710 prior to applying the droplets of ink on the sheet 20 and prior to arranging the sheet 20 on the transport belt 11.

Subsequently, in step S712 it is determined whether the ink coverage $I_{sheet}$ on sheet 20 is higher than a threshold ink coverage $I_{threshold}$. The threshold ink coverage $I_{threshold}$ is a percentage of the maximum ink coverage of the sheet above which dew formation may occur on any of the print heads 12*a*-12*d* due to the ink coverage. For example the threshold ink coverage $I_{threshold}$ is expressed in percentage of droplets of ink applied on the sheet 20 relative to the maximum of droplets of ink, which can be applied. In this example the threshold duty $I_{threshold}$ is determined by the distance control system 120 to be 30%.

In case no, no dew formation is to be expected on any print head in response to the ink coverage on the sheet 20, and a sheet-to-sheet distance $S_1$ is selected in step S714 based on the sheet temperature $T_{sheet}$ only.

In case yes, dew formation is to be expected in response to the ink coverage $I_{sheet}$ on the sheet 20, and in step S716 the sheet-to-sheet distance S is further increased relative to $S_1$, which is merely based on the sheet temperature $T_{sheet}$ (thus S>$S_1$).

Figure 8:
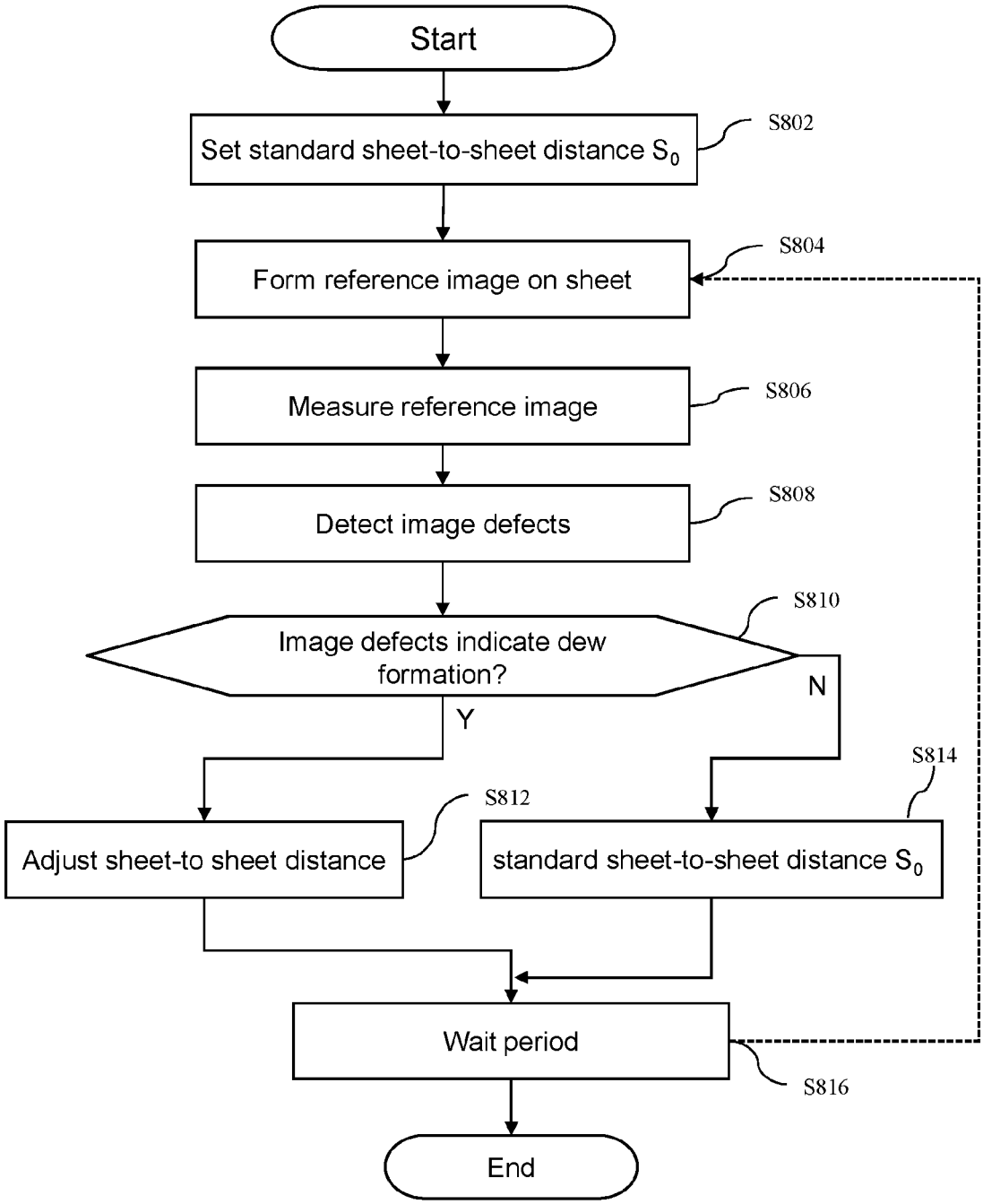
FIG. 8 shows an embodiment of a distance control algorithm for dew correction control according to the present invention.

Now referring to FIG. 8 showing an embodiment of a distance control algorithm for dew correction control according to the present invention.

In FIG. 8 a flow diagram is shown of the distance control algorithm performed by a distance control system arranged for controlling the sheet-to-sheet distance S. In the dew correction mode of the inkjet print station 1 the sheet-to-sheet distance S may be increased, for example with respect to the standard sheet-to-sheet distance $S_0$ as shown in FIG. 3A, in case it is determined that dew is already present on the print head assembly 12*a*-12*d*.

For example, in a first step S802 the sheet-to-sheet distance is set at a standard sheet-to-sheet distance $S_0$ in a normal operation mode, and a sequence of sheets including a reference sheet 20 is transported along the print head assembly 12*a*-12*d* at said standard sheet-to-sheet distance $S_0$ between subsequent sheets as shown in FIG. 3A.

In a next step S804 a reference image is formed on the reference sheet 20 by applying droplets of ink. The reference image is selected for indicating nozzle failure of the nozzles of the print head assembly 12*a*-12*d*.

In a next step S806 the reference sheet 20 is transported along the scanner module 17 as shown in FIG. 1, such as a page wide image sensor, where the reference image is measured by the scanner module 17. The scanner module 17 sends this image data to the controller 100.

In step S808, the controller 100 detects image defects, for example by comparing the received image data of the reference image with respect to predetermined image data of a previous scan. Or by comparing the received image data of the reference image with respect to calculated image data derived from digital image data for controlling the print head assembly 12*a*-12*d*.

In a next step S810, the controller 100 is arranged to determine based on the detected image defects, whether these image defects are caused by dew formation on a nozzle plate of the print head assembly 12*a*-12*d*. For example, in case a predetermined number of a group of nozzles is failing to provide droplets of ink on the reference sheet, it may be assumed that dew has formed on the specific print head or print heads constituting the group of nozzles.

In case the controller 100 determines, that dew on a nozzle plate of the print head assembly 12*a*-12*d* is present, in a next step S812 in the dew correction mode the distance control system adjusts the sheet-to-sheet distance S between subsequent sheets, i.e. increased relative to the standard sheet-to-sheet distance $S_0$, in order to actively remove water vapor from the print region. This active removal of the moisture of the print region enhances the evaporation rate of the dew from the print head assembly 12*a*-12*d*.

In case the controller 100 determines, that dew is not present on the print head assembly 12*a*-12*d*, in a next step S814 the distance control system in said normal operation mode maintains the standard sheet-to-sheet distance $S_0$ between subsequent sheets.

In step S816 this dew correction mode of step S812 or the normal operation mode of step S814 is maintained for a certain period. During said period images may be formed on sheets, wherein the sheets have the sheet-to-sheet distance set between sub sequent sheets in step S812 or step S814 respectively.

After said waiting period the steps S804-S816 are repeated.

For example, after a dew correction mode set in step S812, it is determined in step S810, by measuring a newly printed reference image on a reference sheet according to steps S804-S806, whether the dew is no longer present on the print head assembly 12*a*-12*d* based on image defects newly detected in step S808.

In case yes, in a next step S812 the selected sheet-to-sheet distance S in the dew correction mode is maintained, or the sheet-to-sheet distance S is further increased in case of persisting image defects.

In case no and the image defects are reduced to a level, which indicates that dew is no longer present, the sheet-to-sheet distance S is reduced back to the standard sheet-to-sheet distance $S_0$ according to step S814.

Finally, in case the printing system goes into a standby mode without processing sheets, the distance control system temporarily stops the distance control algorithm.

Figure 9:
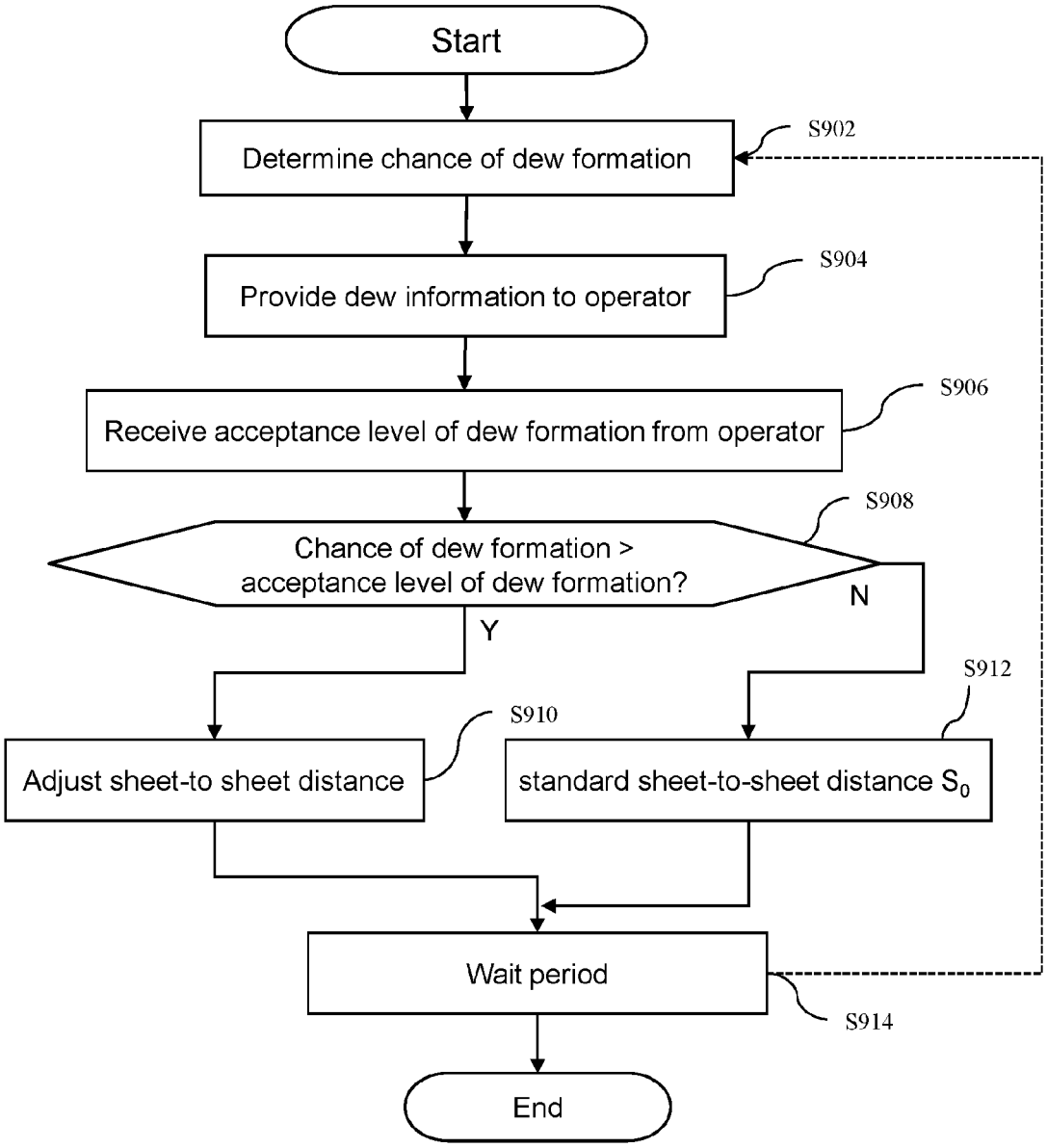
FIG. 9 shows an embodiment of an operator control for dew formation according to the present invention.

Now referring to FIG. 9 showing an embodiment of an operator control for dew formation according to the present invention.

In FIG. 9 a flow diagram is shown of the operator control for controlling the sheet-to-sheet distance S. In the operator control mode of the inkjet print station 1, shown in FIG. 4, the sheet-to-sheet distance S may be controlled by the distance control system 120 based on an operator input indicating the dew formation attribute. For example, before starting the procedure the sheet-to-sheet distance is selected as a standard sheet-to-sheet distance $S_0$ of a normal operation mode, In a first step S902 a chance of dew formation is determined, thereby assuming the sheet-to-sheet distance is selected as the standard sheet-to-sheet distance $S_0$. In the first step S902, the chance of dew formation may be determined based on a sheet temperature and further based on a dew threshold temperature, such as a dew threshold temperature determined according to a calibration process described in relation to FIG. 5C. Additionally or alternatively, the chance of dew formation may be determined based on a duty cycle of a set of nozzles of the print head assembly for forming the image and a threshold duty, such as described in relation to FIGS. 6A-6C. Additionally or alternatively, the chance of dew formation may be determined based on an ink coverage of an image to be formed on a sheet 20 and a threshold ink coverage, such as described in relation to FIG. 7. Additionally or alternatively, the chance of dew formation may be determined based on processing a reference image on a sheet, such as by using the steps S802-S808 of the workflow shown in FIG. 8.

In a second step S904, dew information is provided to an operator, such as by using a display for displaying information, wherein the dew information indicates the chance of dew formation as determined in step S902. In this step, the chance of dew formation may be indicated by a gradation level, such as -no chance-, -low chance-, -medium chance-, and -high chance-, and may be indicated by a statistical percentage, such as a percentage number or percentage range of the range between 0% and 100%.

In a next step S906, an acceptance level of the chance of dew formation is received from the operator, such as by using a keyboard input device or using a touch screen input device. The acceptance level indicates the maximum allowed level of chance of dew formation, which may be allowed during forming the image on the sheet 20 by the print head assembly 12*a*-12*d*. For example, in step S906 the operator may select 0% as acceptance level if the print quality of the images is considered far more important than the print productivity. In an Alternative example, in step S906 the operator may select 50% as acceptance level if the print quality of the images is not critical and the print productivity is considered more important.

In a next step S908, the chance of dew formation, as determined in step S902 based on the present sheet-to-sheet distance, is compared to the acceptance level of the chance of dew formation, as received from the operator in step S906. In case the chance of dew formation is higher than the acceptance level of the chance of dew formation, then is proceeded to step S910. In case the chance of dew formation is equal to or lower than the acceptance level of the chance of dew formation, then is proceeded to step S912.

In step S910, which is a dew prevention mode, the distance control system 120 adjusts the sheet-to-sheet distance S between subsequent sheets, i.e. increased relative to the standard sheet-to-sheet distance $S_0$, in order to actively remove water vapor from the print region, thereby reducing the chance of dew formation. This active removal of the moisture of the print region enhances the evaporation rate of the dew from the print head assembly 12*a*-12*d*.

In step S912, which is normal operation mode as the chance of dew formation is not higher than the acceptance level of the chance of dew formation, the distance control system 120 maintains the standard sheet-to-sheet distance $S_0$ between subsequent sheets.

In step S914 this dew prevention mode of step S910 or the normal operation mode of step S912 is maintained for a certain period. During said period images may be formed on sheets, wherein the sheets have the sheet-to-sheet distance set between sub sequent sheets in step S910 or step S912 respectively.

After said waiting period the steps S902-S914 are repeated.

For example, when starting a next print job, the steps S902-S914 may be repeated to adjust the sheet-to-sheet distance S for the next print job based on a new operator input on the acceptance level of the chance of dew formation. The operator may reconsider the acceptance level in step S906, such as when the print quality of the images of the earlier print job is too low or when the print productivity is lower than desired and the print quality of the images is sufficient.

Additionally to the embodiment described, in step S906 an expected print productivity may be indicated for each acceptance level of the chance of dew formation. For example, it may be indicated to the operator that when selecting 25% as acceptance level, the print productivity will be 50% lower than the print productivity in the normal operation mode, or that the time for printing the print job will double compared to the normal operation mode. In this way, the operator is given a clear indication what the consequence will be of the selection of the acceptance level of chance of dew formation, given the circumstances at the time of printing.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for printing on a plurality of sheets, the method comprising the steps of:

a) arranging the plurality of sheets on a support surface of an endless conveyor, the plurality of sheets including a first sheet and a second sheet being arranged at a sheet-to-sheet distance between one another;

b) advancing the plurality of sheets on the support surface in a conveying direction along a print head assembly for applying droplets of ink on the sheets;

c) providing a suction force through perforations arranged in the support surface for holding the plurality of sheets on the support surface, wherein the suction force provides an air flow through uncovered perforations present in the sheet-to-sheet distance in a print region between the print head assembly and the support surface;

d) forming an image by the print head assembly on each of the plurality of sheets supported on the support surface of the conveyor by applying droplets of ink; and e) controlling the sheet-to-sheet distance in response to a dew formation attribute for indicating dew formation on the print head assembly.

2. The method according to claim 1, wherein the dew formation attribute is a sheet temperature of the first sheet and wherein, prior to step a), in step e) the sheet-to-sheet distance is based on the sheet temperature of the first sheet.

3. The method according to claim 2, wherein the step e) further comprises the steps of:

f) determining a dew threshold temperature of the first sheet for dew formation on the print head assembly; and g) comparing the sheet temperature to the dew threshold temperature.

4. The method according to claim 3, wherein the sheet-to-sheet distance is selected to be substantially equal to a standard distance in case the sheet temperature is equal to or lower than the dew threshold temperature.

5. The method according to claim 4, wherein the print head assembly comprises a first print head and the method further comprising, prior to step a), the step of:

h) determining a local print duty of a group of nozzles of the first print head for applying the droplets of ink in an area on the first sheet during the step d), wherein the step e) further comprises the step of:

i) increasing the sheet-to-sheet distance based on the local print duty in case the local print duty is higher than a threshold duty.

6. The method according to claim 3, wherein the sheet-to-sheet distance is adjusted higher relative to a standard distance based on the sheet temperature in case the sheet temperature is higher than the dew threshold temperature.

7. The method according to claim 4, the method further comprising the step of:

j) determining an ink coverage on the first sheet of the image forming step d), wherein the step e) further comprises the step of:

k) increasing the sheet-to-sheet distance based on the ink coverage in case the ink coverage is higher than a threshold ink coverage.

8. The method according to claim 6, wherein the print head assembly comprises a first print head and the method further comprising, prior to step a), the step of:

h) determining a local print duty of a group of nozzles of the first print head for applying the droplets of ink in an area on the first sheet during the step d), wherein the step e) further comprises the step of:

i) increasing the sheet-to-sheet distance based on the local print duty in case the local print duty is higher than a threshold duty.

9. The method according to claim 6, the method further comprising the step of:

j) determining an ink coverage on the first sheet of the image forming step d), wherein the step e) further comprises the step of:

k) increasing the sheet-to-sheet distance based on the ink coverage in case the ink coverage is higher than a threshold ink coverage.

10. The method according to claim 3, wherein the print head assembly comprises a first print head and the method further comprising, prior to step a), the step of:

h) determining a local print duty of a group of nozzles of the first print head for applying the droplets of ink in an area on the first sheet during the step d), wherein the step e) further comprises the step of:

i) increasing the sheet-to-sheet distance based on the local print duty in case the local print duty is higher than a threshold duty.

11. The method according to claim 10, the method further comprising the step of:

j) determining an ink coverage on the first sheet of the image forming step d), wherein the step e) further comprises the step of:

k) increasing the sheet-to-sheet distance based on the ink coverage in case the ink coverage is higher than a threshold ink coverage.

12. The method according to claim 3, the method further comprising the step of:

j) determining an ink coverage on the first sheet of the image forming step d), wherein the step e) further comprises the step of:

k) increasing the sheet-to-sheet distance based on the ink coverage in case the ink coverage is higher than a threshold ink coverage.

13. The method according to claim 3, wherein the step e) further comprises the step of selecting the dew threshold temperature based on a sheet attribute of the first sheet, the sheet attribute preferably comprising at least one of a size of the first sheet and a sheet material of the first sheet.

14. The method according to any of claim 3, wherein the step c) comprises adjusting the suction force based on the sheet temperature to increase the air flow in the print region between the print head assembly and the support surface in case the sheet temperature is higher than the dew threshold temperature.

15. The method according to claim 1, wherein the plurality of sheets comprises a reference sheet, the dew formation attribute is an image defect and wherein, prior to arranging the first sheet and the second sheet during step a), in step e) the dew formation attribute is determined by the steps of:

l) forming an image on the reference sheet according to step d);

m) measuring the image formed on the reference sheet; and n) detecting image defects of the measured image.

16. The method according to claim 1, wherein the step e) further comprises the step of:

o) receiving from an operator the dew formation attribute for controlling the sheet-to-sheet distance.

17. An inkjet printing apparatus for printing on a plurality of sheets, comprising:

an endless conveyor comprising a support surface arranged for supporting the plurality of sheets, including a first sheet and a second sheet arranged at a sheet-to-sheet distance between one another, and conveying the sheets in a conveying direction along a print station;

the print station comprising a print head assembly arranged for applying droplets of ink on the plurality of sheets;

a suction device arranged for applying a suction force through perforations arranged in the support surface for holding the sheets on the support surface, wherein the suction force provides an air flow through uncovered perforations present in the sheet-to-sheet distance in a print region between the print head assembly and the support surface; and a distance control system configured for controlling the sheet-to-sheet distance on the support surface in response to a dew formation attribute for indicating dew formation on the print head assembly.

18. The inkjet printing apparatus according to claim 17, wherein the distance control system is configured to drive a sheet feed device adapted for arranging the first and second sheet on the support surface at the determined sheet-to-sheet distance.

19. The inkjet printing apparatus according to claim 17, wherein the inkjet printing apparatus further comprises a sheet temperature system for determining a sheet temperature of the first sheet and the distance control system is configured for controlling the sheet-to-sheet distance based on the sheet temperature of the first sheet, the sheet temperature system preferably comprising a sensor for sensing the sheet temperature of the first sheet.

20. The inkjet printing apparatus according to claim 17, wherein the inkjet printing apparatus further comprises an image processing unit comprising a sensor device configured for measuring an image formed on a reference sheet by the print station and an image analyzing unit for detecting image defects of the measured image, said image defects indicating dew formation on the print head assembly; and wherein the distance control system is configured for controlling the sheet-to-sheet distance based on the image defects detected by the image analyzing unit.

* * * * *